US005498928A

United States Patent [19]

Lapatovich et al.

[11] Patent Number: 5,498,928

[45] Date of Patent: Mar. 12, 1996

[54] ELECTRODELESS HIGH INTENSITY DISCHARGE LAMP ENERGIZED BY A ROTATING ELECTRIC FIELD

[75] Inventors: Walter P. Lapatovich, Marlborough; Scott J. Butler, North Oxford, both of Mass.; Jason R. Bochinski, Springfield, Oreg.

[73] Assignee: Osram Sylvania Inc., Danvers, Mass.

[21] Appl. No.: 248,921

[22] Filed: May 24, 1994

[51] Int. Cl.[6] ..... H05B 41/24

[52] U.S. Cl. ..... 315/39; 315/248; 315/344

[58] Field of Search ..... 315/39, 248, 344

[56] References Cited

U.S. PATENT DOCUMENTS

| | | | |
|---|---|---|---|
| 3,189,901 | 6/1965 | Cutolo | 342/350 |
| 3,442,758 | 5/1969 | Penfold et al. | 315/39 X |
| 4,504,768 | 3/1985 | Ury et al. | 315/248 |
| 4,749,915 | 6/1988 | Lynch et al. | 315/248 |
| 4,792,732 | 12/1988 | O'Loughlin | 315/248 X |
| 4,803,404 | 2/1989 | Anderson | 313/634 |
| 4,887,008 | 12/1989 | Wood | 315/39 |
| 4,954,755 | 9/1990 | Lynch et al. | 315/248 |
| 4,972,120 | 11/1990 | Witting | 313/638 |
| 4,975,625 | 12/1990 | Lynch et al. | 315/344 |
| 5,070,277 | 12/1991 | Lapatovich | 315/248 |
| 5,130,612 | 7/1992 | Lapatovich et al. | 315/248 |
| 5,144,206 | 9/1992 | Butler et al. | 315/248 |
| 5,146,137 | 9/1992 | Cresche et al. | 315/248 X |
| 5,227,698 | 7/1993 | Simpson et al. | 315/248 |
| 5,241,246 | 8/1993 | Lapatovich et al. | 315/248 |
| 5,280,217 | 1/1994 | Lapatovich et al. | 315/39 |
| 5,313,144 | 5/1994 | Butler et al. | 315/248 |
| 5,339,008 | 8/1994 | Lapatovich et al. | 315/39 X |

FOREIGN PATENT DOCUMENTS

| | | |
|---|---|---|
| 0397421A2 | 11/1990 | European Pat. Off. . |
| 0457242A1 | 11/1991 | European Pat. Off. . |
| 0524001A1 | 1/1993 | European Pat. Off. . |

*Primary Examiner*—Benny T. Lee
*Attorney, Agent, or Firm*—Carlo S. Bessone

[57] ABSTRACT

An electrodeless high intensity discharge lamp includes a lamp capsule containing a fill material for emitting radiation upon excitation by high frequency electromagnetic energy, a plurality of applicators spaced around a lamp capsule for nonresonant coupling of high frequency energy to the lamp capsule, a high frequency source for supplying high frequency power, and a power splitter and phase shifter for coupling high frequency power from the source to the applicators such that an electric field applied to the lamp capsule rotates at the frequency of the source. The applied high frequency energy is distributed over the lamp capsule so that the tendency for lamp envelope hot spots is reduced. Preferably, four helical couplers are spaced at 90° intervals around the lamp capsule. The high frequency power applied to adjacent applicators is shifted in phase by 90°.

21 Claims, 10 Drawing Sheets

ELECTRODELESS HIGH INTENSITY DISCHARGE LAMP ENERGIZED BY A ROTATING ELECTRIC FIELD

FIELD OF THE INVENTION

This invention relates to electrodeless high intensity discharge lamps and, more particularly, to electrodeless high intensity discharge lamps wherein the tendency for lamp envelope hot spots to develop during operation is reduced by energizing the lamp with a rotating electric field.

BACKGROUND OF THE INVENTION

Electrodeless high intensity discharge (HID) lamps have been described extensively in the prior art. In general, electrodeless HID lamps include an electrodeless lamp capsule containing a volatizible fill material. The lamp capsule is mounted in a fixture which is designed for coupling high frequency energy to the lamp capsule. The high frequency energy produces a light emitting plasma discharge within the lamp capsule. Recent advances in the application of microwave power to lamp capsules operating in the tens of watts range are disclosed in U.S. Pat. No. 5,070,277 issued Dec. 3, 1991 to Lapatovich; U.S. Pat. No. 5,130,612 issued Jul. 4, 1992 to Lapatovich et al; U.S. Pat. No. 5,241,246 issued Aug. 31, 1993 to Lapatovich et al and U.S. Pat. No. 5,144,206 issued Sep. 1, 1992 to Butler et al. As a result, compact electrodeless HID lamps and associated applicators have become practical.

These patents describe small cylindrical lamp capsules wherein high frequency energy is coupled to opposite ends of the lamp with a 180° phase shift. The applied electric field is colinear with the arc tube axis and produces a substantially linear discharge within the lamp capsule. The disclosed lamps provide highly satisfactory performance. However, the high frequency power (and electric field) is concentrated at the ends of the lamp capsule and produces hot spots and potential failures in the vicinity of the field applicators.

Lamps with different geometries have been disclosed in U.S. Pat. No. 4,803,404 issued Feb. 7, 1989 to Anderson; U.S. Pat. No. 4,972,120 issued Nov. 20, 1990 to Witting and U.S. Pat. No. 4,887,008 issued Dec. 12, 1989 to Wood. These patents disclose relatively high power devices with relatively large dimensions. In addition, power is coupled to the disclosed lamps through magnetic induction rather than capacitive coupling.

A microwave lamp energized by a rotating field of constant ellipticity is disclosed in U.S. Pat. No. 5,227,698 issued Jul. 13, 1993 to Simpson et al. An electrodeless lamp is mounted within a resonant cavity which includes a solid metallic portion and a mesh portion. Microwave energy is coupled through slots in the resonant cavity to produce a rotating field. Waveguides are used to couple microwave energy from a source to the slots in the resonant cavity. The disclosed lamp is relatively large and expensive. Coupling microwave energy to a lamp located in a resonant cavity also requires placing the lamp in an optically opaque metal structure. It is inefficient to couple light out of a structure of this type.

An electrodeless lamp wherein the lamp capsule is rotated in a stream of compressed air within a resonant cavity to facilitate cooling is disclosed in U.S. Pat. No. 4,975,625 issued Dec. 4, 1990 to Lynch et al. This configuration has the disadvantage of requiring a motor for rotating the lamp capsule, and forced air cooling. Filtering of the cooling air is also required to prevent abrasion of the lamp by dust particles and premature lamp failure. Additional electrodeless lamps are disclosed in U.S. Pat. No. 4,504,768 issued Mar. 12, 1985 to Ury et al; U.S. Pat. No. 4,749,915 issued Jun. 7, 1988 to Lynch et al and U.S. Pat. No. 4,954,755 issued Sep. 4, 1990 to Lynch et al.

SUMMARY OF THE INVENTION

According to the present invention, an electrodeless high intensity discharge lamp comprises a lamp capsule containing a fill material for emitting radiation upon excitation by high frequency electromagnetic energy, a plurality of electric field applicators spaced around the lamp capsule for nonresonant coupling of high frequency electromagnetic energy to the lamp capsule, a high frequency source for supplying high frequency power, and a power splitter and phase shifter for coupling high frequency power from the source to the electric field applicators such that an electric field applied to the lamp capsule by the applicators rotates at the frequency of the source. The applied high frequency energy is distributed over the lamp capsule so that the tendency for lamp envelope hot spots is reduced. Motors, forced air cooling and resonant cavities are not required.

Preferably, the electric field applicators are positioned in a plane that passes through the lamp capsule and are equally spaced around the lamp capsule. In a preferred embodiment, four applicators are positioned at 90° intervals around the lamp capsule, and the power splitter and phase shifter includes means for applying high frequency power to the applicators on opposite sides of the lamp capsule at 180° out of phase and for applying high frequency power to adjacent ones of the applicators at 90° out of phase. The resulting electric field rotates in the plane of the applicators at the frequency of the source. Each of the electric field applicators may comprise a helical coupler, a cup applicator, a loop applicator, or any other suitable applicator.

In a preferred embodiment, the power splitter and phase shifter comprises first, second and third signal splitters, each having two equal amplitude outputs phased shifted by 90°. The first signal splitter has an input connected to the power source. The second signal splitter has an input connected to one output of the first signal splitter, and the third signal splitter has an input connected to the other output of the first signal splitter. The transmission lines connecting the second and third signal splitters to the outputs of the first signal splitter have different lengths, which are selected such that the inputs to the second and third signal splitters are 180° out of phase. The outputs of the second and third signal splitters are respectively coupled to the four electric field applicators. Preferably, the first, second and third signal splitters comprise branch line quadrature hybrid couplers fabricated in a microstrip transmission line.

In one embodiment, the lamp capsule is substantially spherical and has an inside diameter in the range of 1–12 millimeters. In another embodiment, the lamp capsule comprises a prolate or oblate ellipsoid of revolution. The lamp capsule preferably has a circular cross section in the plane of the rotating electric field. The lamp capsule preferably includes an internal convex dimple for controlling condensation distribution within the lamp capsule. The fill material preferably comprises an inert gas and a volatizible material, such as mercury and a metal halide.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
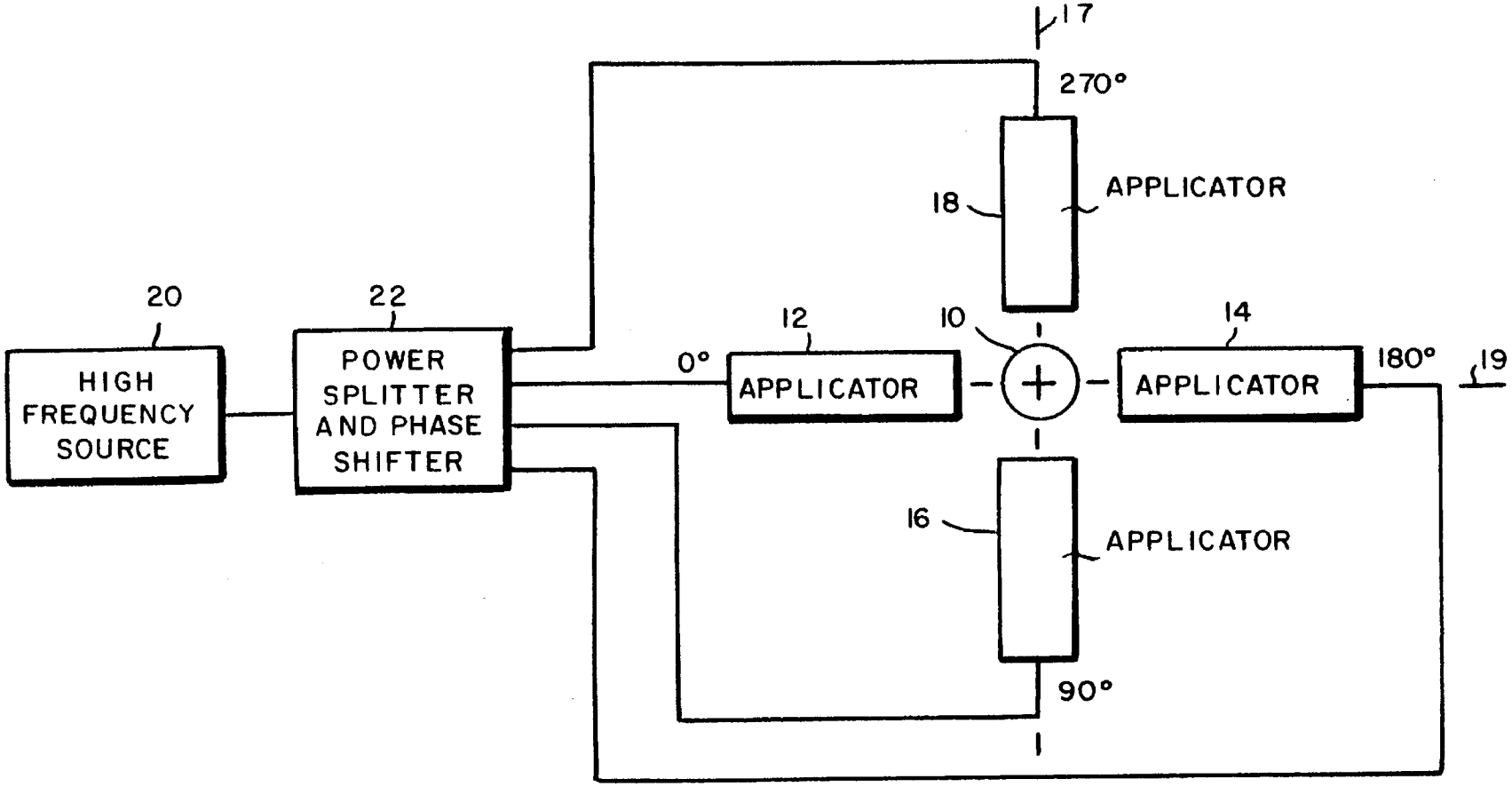
FIG. 1 is a block diagram of an electrodeless high intensity discharge lamp in accordance with the present invention.

A block diagram of an electrodeless high intensity discharge lamp in accordance with the present invention is shown in FIG. 1. An electrodeless lamp capsule 10 contains a volatizible fill material which emits radiation upon excitation by high frequency electromagnetic energy. By way of example, the lamp capsule 10 can be spherical and contain an inert gas, mercury and a metal halide. The lamp capsule 10 is described in detail below.

Electric field applicators 12, 14, 16 and 18 are spaced around the lamp capsule 10 and are located in close proximity to the lamp capsule 10. The applicators are used for nonresonant coupling of high frequency electromagnetic energy to the lamp capsule 10. The applicators 12, 14, 16 and 18 are preferably located in a plane defined by orthogonal axes 17 and 19, which intersect at the center of lamp capsule 10. In the embodiment of FIG. 1, the electric field applicators 12, 14, 16 and 18 are spaced at 90° intervals with respect to the center of the lamp capsule. Thus, applicators 12 and 14 are located on axis 19 on opposite sides of lamp capsule 10, and applicators 16 and 18 are located on axis 17 on opposite sides of lamp capsule 10.

A high frequency source 20 supplies high frequency power to a power splitter and phase shifter 22. The power splitter and phase shifter 22 provides outputs at the frequency of source 20 to electric field applicators 12, 14, 16 and 18. The phases and amplitudes of the signals applied to applicators 12, 14, 16 and 18 are selected such that an electric field applied to the lamp capsule 10 by the applicators rotates at the frequency of the power source 20. In particular, the outputs of power splitter and phase shifter 22 have equal amplitudes, and the signals applied to applicators 12 and 14 are 180° out of phase. Similarly, the signals applied to applicators 16 and 18 are 180° out of phase. The signals applied to adjacent applicators are 90° out of phase. Applicators 12, 16, 14 and 18 are shown in FIG. 1 as having signals with phases of 0°, 90°, 180° and 270°, respectively, applied thereto.

The power source 20 can operate at any frequency at which substantial power can be developed. In particular, the operating frequency is typically selected in one of the Industrial, Scientific and Medical (ISM) frequency bands assigned by the FCC bands. The frequencies centered around 13.56 MHz, 40.7 MHz, 915 MHz, 2450 MHz, 5.86 GHz, 24.125 GHz, 61.25 GHz, 122.5 GHz and 245 GHz are particularly appropriate.

The drive system for lamp capsule 10, including electric field applicators 12, 14, 16 and 18, power splitter and phase shifter 22 and high frequency source 20, sustains a discharge of approximately spheroidal shape within lamp capsule 10 using a rotating electric field. The rotating electric field enables power to be input to the plasma within lamp capsule 10 in a surface averaged way and reduces the effect of localized heating on the lamp envelope. This avoids the phenomenon known as "arc attachment" which commonly causes hot spots to develop in the wall of the lamp capsule. Since the reactions which degenerate the lamp capsule are generally supralinear with temperature, the present invention reduces the probability of those reactions, increases the life of the lamp capsule and makes it possible to energize the lamp at high power levels. Another advantage of the lamp of the present invention is the "point-like" nature of the spherical plasma developed within the lamp capsule, which may be useful for coupling to optical collectors such as in projection applications.

Figure 2:
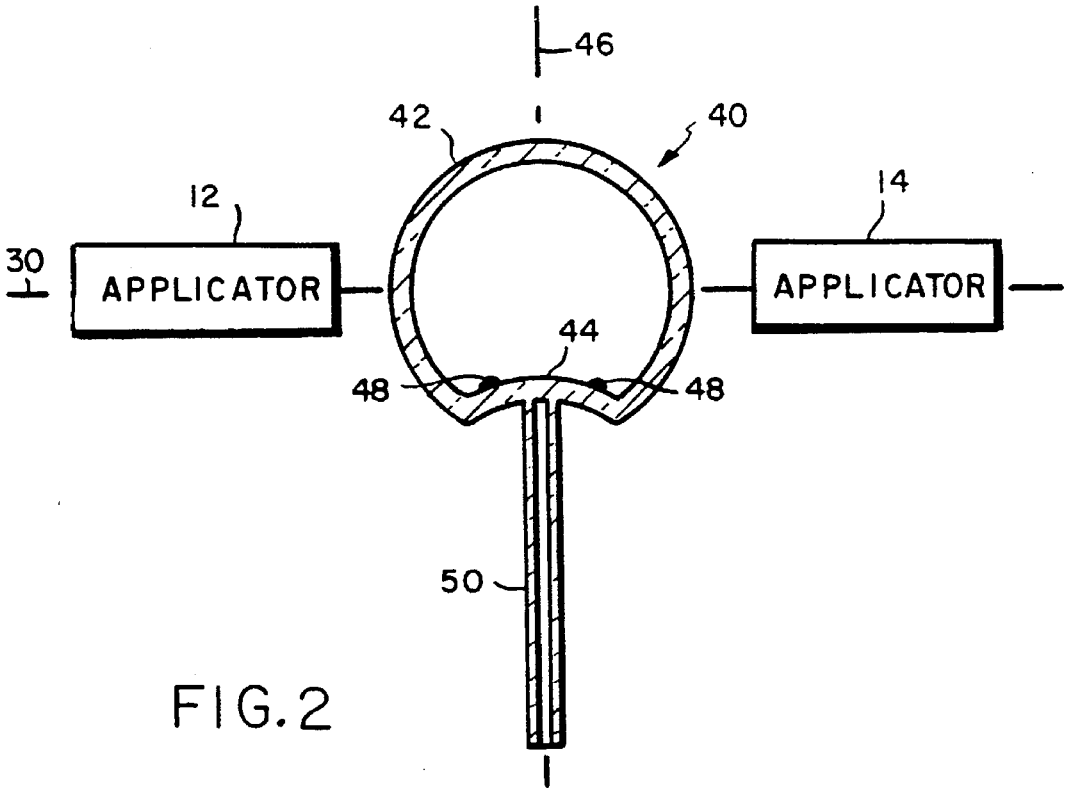
FIG. 2 is a cross sectional view of a spherical lamp capsule suitable for use in the lamp of the present invention.
Figure 3:
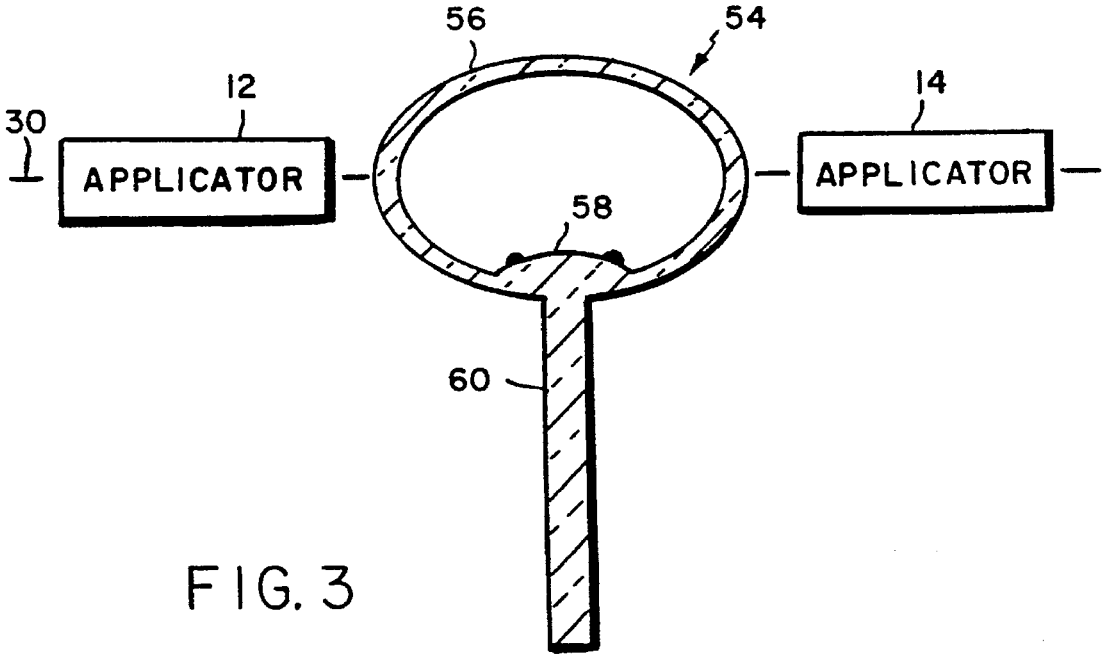
FIG. 3 is a cross sectional view of an ellipsoidal lamp capsule suitable for use in the lamp of the present invention.

Examples of suitable lamp capsules for the electrodeless lamp of FIG. 1 are shown in FIGS. 2 and 3. As noted above, the applicators 12, 14, 16 and 18 are preferably positioned in a plane 30 (see FIGS. 2 and 3) of excitation that passes through the center of lamp capsule 10 (see FIG. 1). FIGS. 2 and 3 are cross sections taken perpendicular to the plane 30 of the applicators shown in FIG. 1. The envelope of the lamp capsule is fabricated of a light transmissive material through which the high frequency power passes substantially unattenuated. The material of the lamp envelope may be vitreous silica, commonly called quartz, of any grade, but water-free grades are especially preferred. Synthetic fused silica may also be utilized to fabricate the lamp envelope. When the discharge can be run at lower wall temperatures, the lamp envelope may be fabricated of other glassy material, such as aluminosilicate glass or borosilicate glass. The lamp envelope may be generally spherical in shape or may be prolate or oblate ellipsoidal in cross section orthogonal to the plane 30 of excitation. Preferably, the lamp envelope has an approximately circular cross section in the plane 30 of excitation. The lamp envelope may have one or more dimples into the interior volume to assist in controlling the condensate distribution. The control of condensate distribution has a marked effect on the light output. Excellent performance is obtained when the condensate forms a ring around the dimple. The lamp envelope includes means for supporting it within the excitation gap between electric field applicators 12, 14, 16 and 18. The support may be in the form of a tubular or solid rod attached to the lamp envelope and colinear with the axis of rotational symmetry of the lamp capsule. A second support colinear with the first and attached to the opposite side of the lamp envelope may also be used.

A lamp capsule 40 having a generally spherical lamp envelope 42 is shown in FIG. 2 positioned between applicators 12 and 14. A dimple 44 extends into the lamp envelope 42 and produces a convex shape within the internal volume of the lamp envelope. Condensate 48 forms in a ring around the dimple 44. The lamp envelope 42 is supported by a tubular support 50 on axis 46 of rotational symmetry.

A lamp capsule 54 shown in FIG. 3 positioned between applicators 12 and 14 includes a lamp envelope 56 with a cross section that is ellipsoidal in a plane perpendicular to plane 30. The lamp envelope 56 has a circular cross section in plane 30. The lamp envelope 56 includes a dimple 58 and is supported by a solid rod 60.

The lamp capsule 10 for the electrodeless lamp of FIG. 1 contains an ionizable starting gas, such as argon, in the pressure range of 1 to 760 torr. Other inert gases, such as neon, krypton, xenon, nitrogen and mixtures thereof, may be used. A preferred starting gas pressure range is 5 to 100 torr. The lamp envelope also contains a vaporizable fill material which, when volatized, is partially ionized and partially excited to radiating states so that useful light is emitted by the discharge. The metal salts may be sodium scandium iodides or more easily vaporized material, such as tin halides. Other fill materials not containing mercury may also be used. An example of such a fill is sulfur. Fill materials are preferably scaled to the internal volume of the lamp envelope. For example, approximately 33 milligrams (mg) of mercury per cubic centimeter and 3 mg of metal salt per cubic centimeter have produced successful results. Other fill materials known to those skilled in the art may be utilized to generate visible, ultraviolet or infrared radiation.

The spherical lamp capsule preferably has an inner diameter in a range of 1 millimeter (mm) to 12 mm, and more preferably has an inner diameter in a range of 2 mm to 8 mm. The dimensions of the ellipsoidal lamps are similar. The wall thickness is preferably in a range of 0.25 mm to 2.0 mm.

Figure 4:
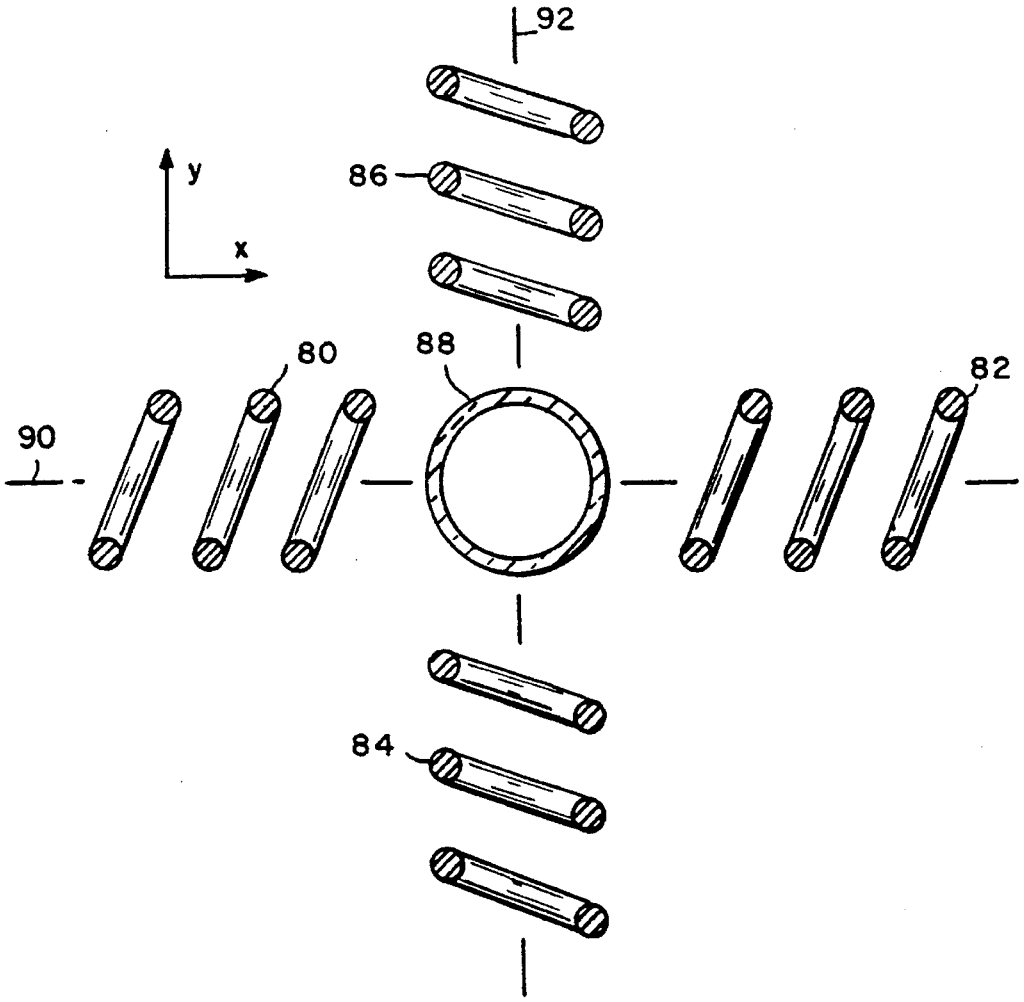
FIG. 4 is a schematic top view of a lamp capsule and four helical couplers.

In a preferred embodiment, the electric field applicators 12, 14, 16 and 18 of FIG. 1 are helical couplers, or helical coils. As shown in FIG. 4, helical couplers 80, 82, 84 and 86 are positioned in a plane that passes through a lamp capsule 88 and are equally spaced around lamp capsule 88 at 90° intervals. The coils of the helical couplers have the same helicity, that is, are all right-handed or all left-handed screws, and are oriented so that each opposing pair generates axial electric fields which add vectorially to produce a maximum electric field within the gap between coils, where the lamp capsule 88 is located. Thus, as shown in FIG. 4, a longitudinal axis 90 of helical couplers 80 and 82 passes through the center of lamp capsule 88, and a longitudinal axis 92 of helical couplers 84 and 88 passes through the center of lamp capsule 88. The axes 90 and 92 intersect at right angles and define the plane of the rotating electric field. The helical couplers are driven by power splitter and phase shifter 22 with equal amplitude signals that are phase shifted by 90° between adjacent helical couplers. Thus, helical couplers 80 and 82 receive signals that are phase shifted by 180°, and helical couplers 84 and 86 receive signals that are phase shifted by 180°. Additional details regarding helical couplers for electrodeless high intensity discharge lamps are disclosed in the aforementioned U.S. Pat. No. 5,070,277, which is hereby incorporated by reference.

Figure 11:
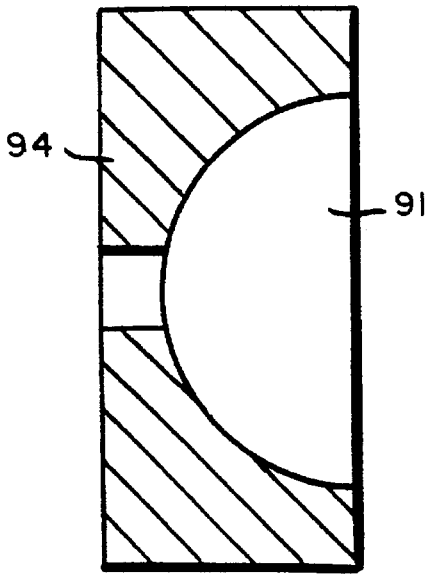
FIG. 11 is a cross sectional view of an end cup applicator suitable for use in the lamp of the present invention.
Figure 12:
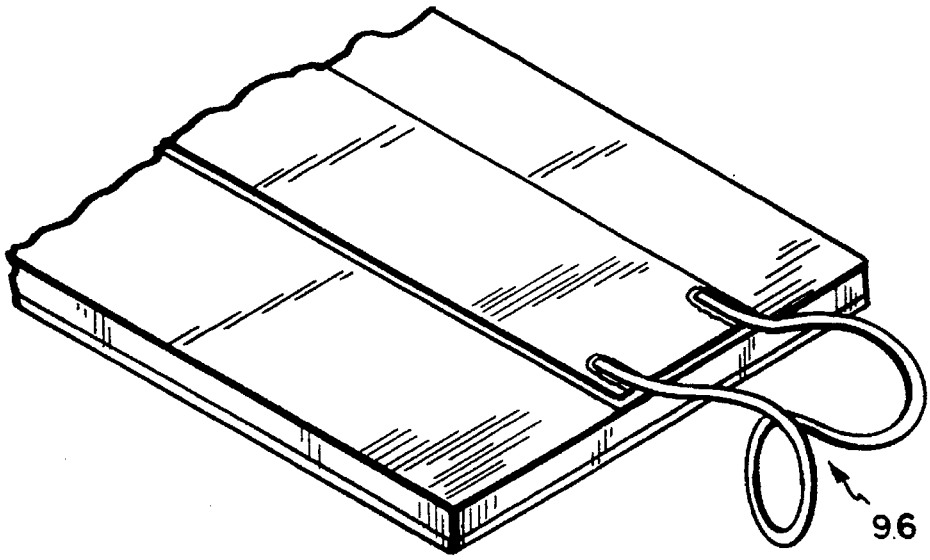
FIG. 12 is a perspective view of a loop applicator suitable for use in the lamp of the present invention.

The electric field applicators 12, 14, 16 and 18 can also comprise end cups or loop applicators. An end cup applicator 94 is illustrated in FIG. 11. The end cup applicator 94 is fabricated of metal or metallized ceramic and includes a concave portion 91 that is positioned in proximity to the lamp capsule. Details regarding end cup applicators for electrodeless lamps are disclosed in the aforementioned U.S. Pat. No. 5,241,246, which is hereby incorporated by reference. A loop applicator 96 is illustrated in FIG. 12. The loop applicator 96 is formed as three partial turns of wire, which are positioned in proximity to the lamp capsule. Details regarding loop applicators for electrodeless lamps are disclosed in the aforementioned U.S. Pat. No. 5,130,612, which is hereby incorporated by reference.

Figure 5:
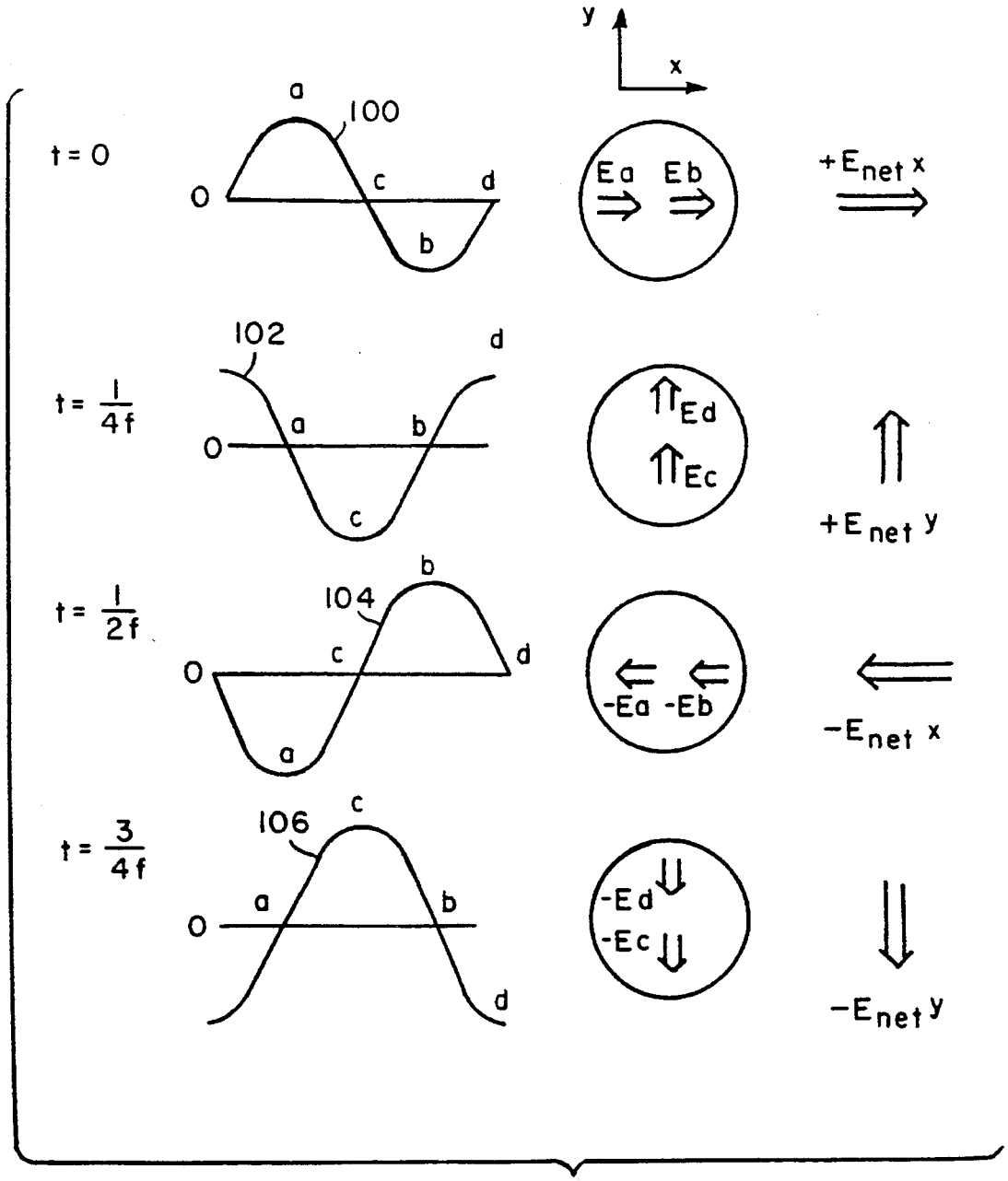
FIG. 5 is a schematic diagram showing the electric fields in the lamp capsule as a function of time.

The operation of helical couplers 80, 82, 84 and 86 to produce a rotating electric field within lamp capsule 88 is illustrated in FIG. 5. The signal phases and resulting electric fields for one complete cycle of the applied high frequency power are illustrated. Each of the waveforms 100, 102, 104 and 106 represents the voltages at helical couplers 80, 82, 84 and 86 (shown in FIG. 4) by points a, b, c and d, respectively, at intervals of one-quarter cycle of the high frequency power. Thus, for example, waveform 100 illustrates the voltages at helical couplers 80, 82, 84 and 86 at time t=0. At time t=0, the voltages applied to couplers 84 and 86 are zero, and there is no electric field along the Y axis (axis 92). The voltages applied to couplers 80 and 82 at time t=0 are at a maximum. Because the voltages are applied 180° out of phase, the resulting electric fields $E_a$ and $E_b$ are in the same direction and add to produce a net electric field $+E_{netx}$ in the positive X direction (along axis 90). A similar analysis shows that the net electric field rotates to the positive Y direction along axis 92 after one-quarter cycle ($+E_{netx}=E_c+E_d$), to the negative X direction after one-half cycle ($-E_{netx}=-E_a-E_b$) and to the negative Y direction after three quarters of a cycle ($-E_{nety}=-E_c-E_d$). Thus, the net electric field rotates at the frequency of the applied high frequency power. The magnitude of the net electric field is constant because equal amplitude voltages are applied to the helical couplers 80, 82, 84 and 86. The electric field vector $E_{net}$ shown in FIG. 5 rotates in the plane of the helical couplers 80, 82, 84 and 86.

Figure 6:
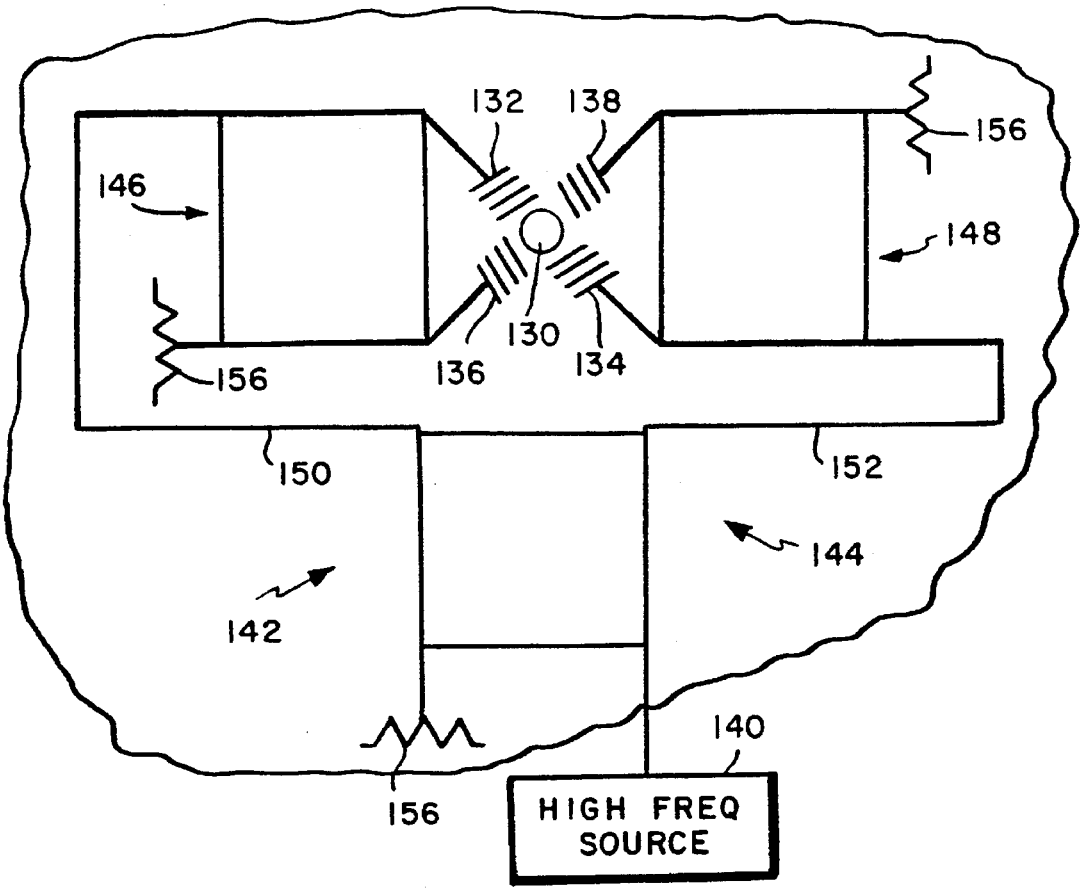
FIG. 6 illustrates a preferred embodiment of the present invention.

An example of an electrodeless high intensity discharge lamp in accordance with the present invention is shown in FIG. 6. A lamp capsule 130 is energized by helical couplers 132, 134, 136 and 138 as described above in connection with FIGS. 4 and 5. The lamp capsule 130 has a spherical shape with an inside diameter of 5 mm and a fill material comprising 2.6 mg of mercury with 0.26 mg of Na-Sc-iodide and 5 torr of argon gas. The helical couplers 132, 134, 136 and 138 are made from 0.025 inch diameter nickel wire. The coil inner diameter is 5 mm, the pitch is 1.46 mm, and the coil has 5.2 turns. A high frequency source 140 supplies power at a frequency of 915 MHz.

A power splitter and phase shifter 142 is fabricated on microstrip transmission line and includes a first branch line quadrature hybrid coupler 144, a second branch line quadrature hybrid coupler 146 and a third branch line quadrature hybrid coupler 148. Each hybrid coupler includes a square pattern of conductors having sides that are approximately one-quarter of the guide wavelength at the center frequency of source 140. The construction of microstrip quadrature hybrid couplers is known generally in the art. Each quadrature hybrid coupler has two outputs with equal amplitudes and a 90° phase shift. The outputs of coupler 144 on lines 150 and 152 are supplied to the inputs of couplers 146 and 148, respectively. Line 150 is approximately one-quarter of a guide wavelength longer than line 152 at the center frequency of source 140 to ensure a 180° phase difference between the inputs to couplers 146 and 148. The outputs of quadrature hybrid coupler 146 are connected to helical couplers 132 and 136. The outputs of quadrature hybrid coupler 148 are connected to helical couplers 134 and 138. The isolation port of each quadrature hybrid coupler is terminated in a 50 ohm resistor 156. As known in the art, the microstrip transmission line pattern shown in FIG. 6 may be formed on a dielectric material, such as Isoclad® GR6 ceramic-filled random glass microfiber-reinforced PTFE composite laminate or BeO having an approximate relative dielectric constant of 6 and having a thickness of 0.050 inch. A ground plane conductor is formed on the opposite side of the dielectric material.

The lamp produced a spherically-shaped plasma and ran stably between 60 and 100 watts. The photometric brightness or luminance of the source was measured as 47 candela/$mm^2$. The spectrum observed showed components of all the metal additives as expected, principally sodium and scandium. Chromaticity coordinates were typically X=0.3908 and Y=0.3354.

An important feature of the present invention is that the power splitter and phase shifter 22 (FIG. 1) provides a high degree of isolation between the lamp capsule 10 and the high frequency source 20. During starting and warmup of electrodeless lamps, the plasma in the lamp capsule is not matched to the circuit that applies high frequency power to the lamp. As a result, significant high frequency power may be reflected by the lamp capsule and may potentially damage the high frequency source. In the configuration of the present invention, the lamp capsule and the source are isolated, thus avoiding potential damage to the source during starting and warmup. With reference to FIG. 6, any reflected power is dissipated in resistors 156 and does not reach high frequency source 140. Thus, the source effectively sees a constant load impedance.

Figure 7:
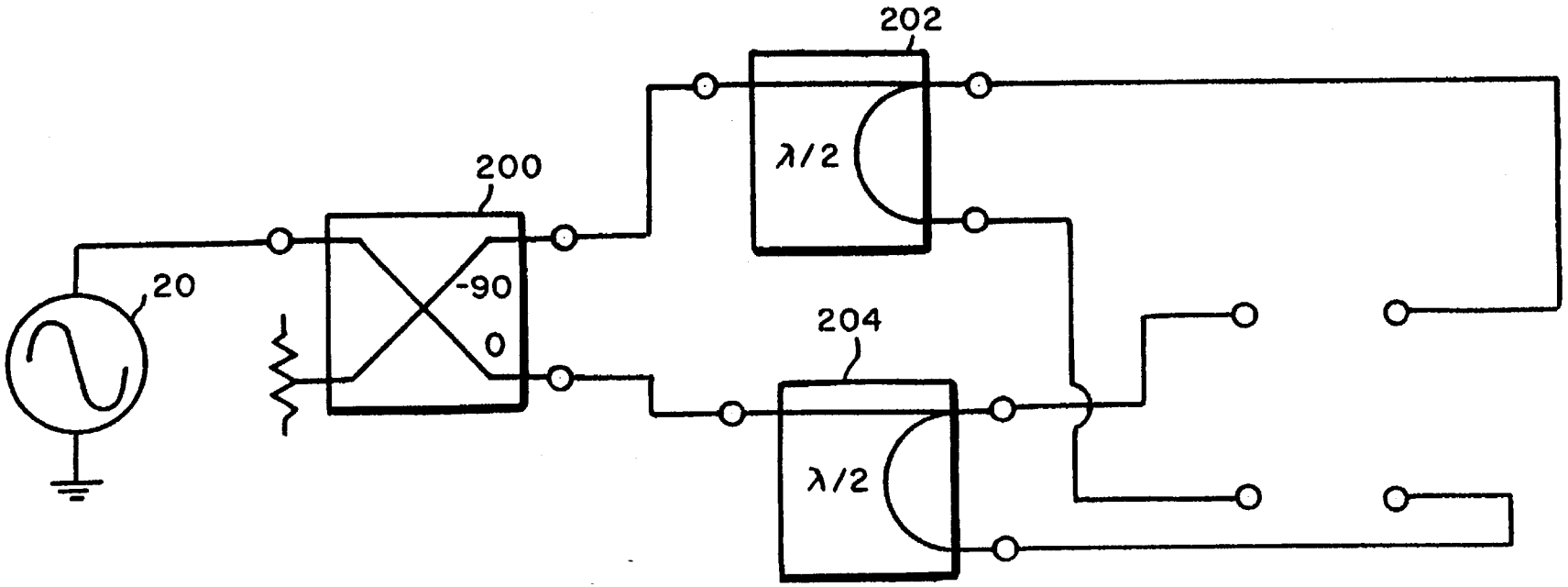
FIG. 7 is a schematic block diagram of a first embodiment of the power splitter and phase shifter shown in FIG. 1.

A block diagram of a first embodiment of the power splitter and phase shifter 22 is shown in FIG. 7. The output of high frequency source 20 is supplied to a quadrature hybrid coupler 200. As noted above, the quadrature hybrid coupler produces two outputs of equal amplitude, which are phase shifted by 90°. A first output of coupler 200 is input to a half wave (2/2) balun 202, and a second output of coupler 200 is input to a half wave (2/2) balun 204. Each half wave balun produces two outputs of equal amplitude, which are phase shifted by 180°. The outputs of each half wave balun 202 and 204 are supplied to electric field applicators on opposite sides of the lamp capsule so as to produce a rotating electric field as described above. The half wave balun is described in detail in the aforementioned U.S. Pat. No. 5,070,277.

Figure 8:
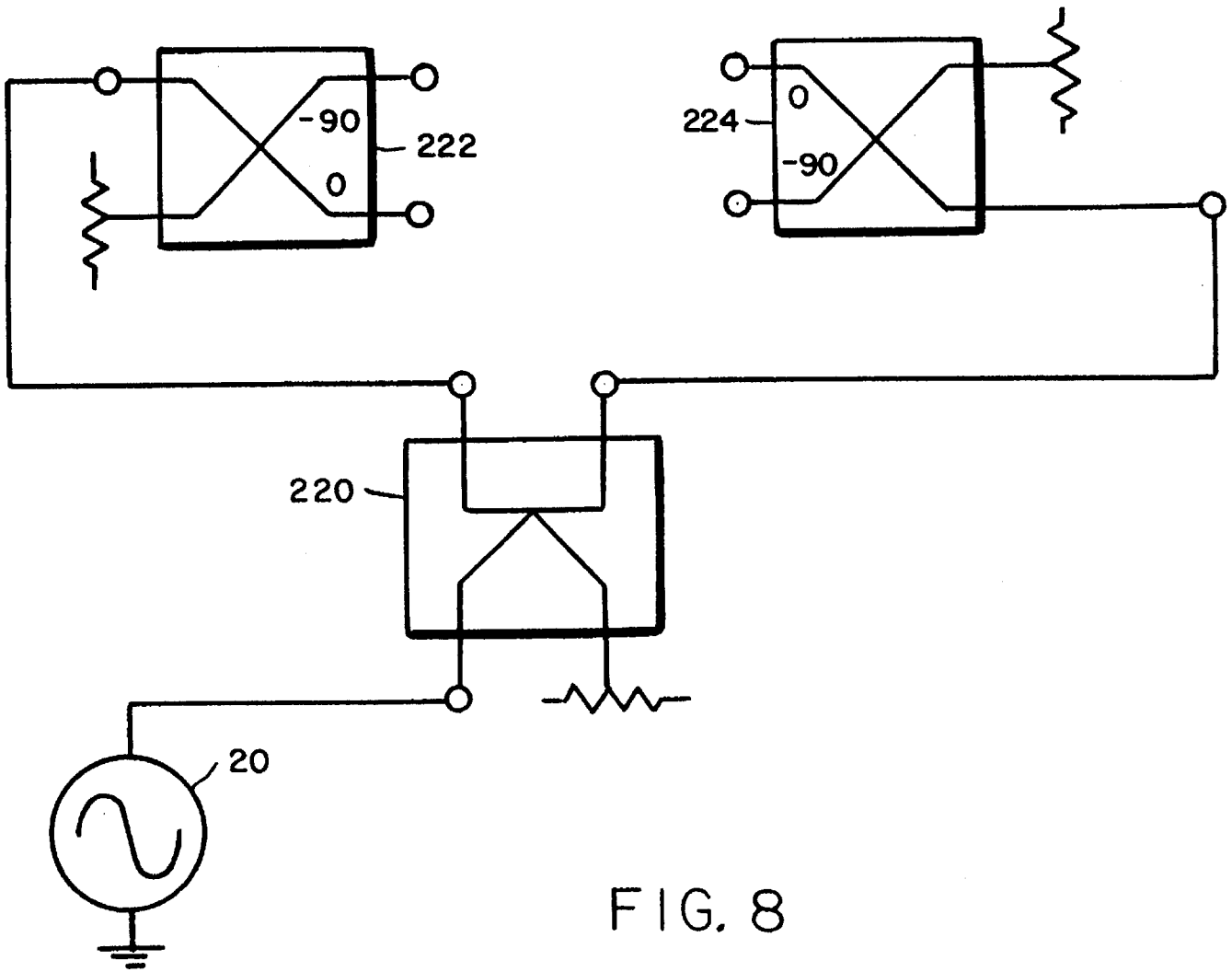
FIG. 8 is a schematic block diagram of a second embodiment of the power splitter and phase shifter shown in FIG. 1.

A second embodiment of the power splitter and phase shifter 22 is shown in FIG. 8. The output of high frequency source 20 is supplied to a 180° hybrid coupler 220. The 180° hybrid coupler generates two outputs of equal amplitude, which are phase shifted by 180°. A first output of coupler 220 is input to a quadrature hybrid coupler 222. A second output of coupler 220 is input to a quadrature hybrid coupler 224. The outputs of the quadrature hybrid couplers 222 and 224 are supplied to the electric field applicators 12, 14, 16 and 18 (not shown in FIG. 8) so as to produce a rotating electric field as described above.

Figure 9:
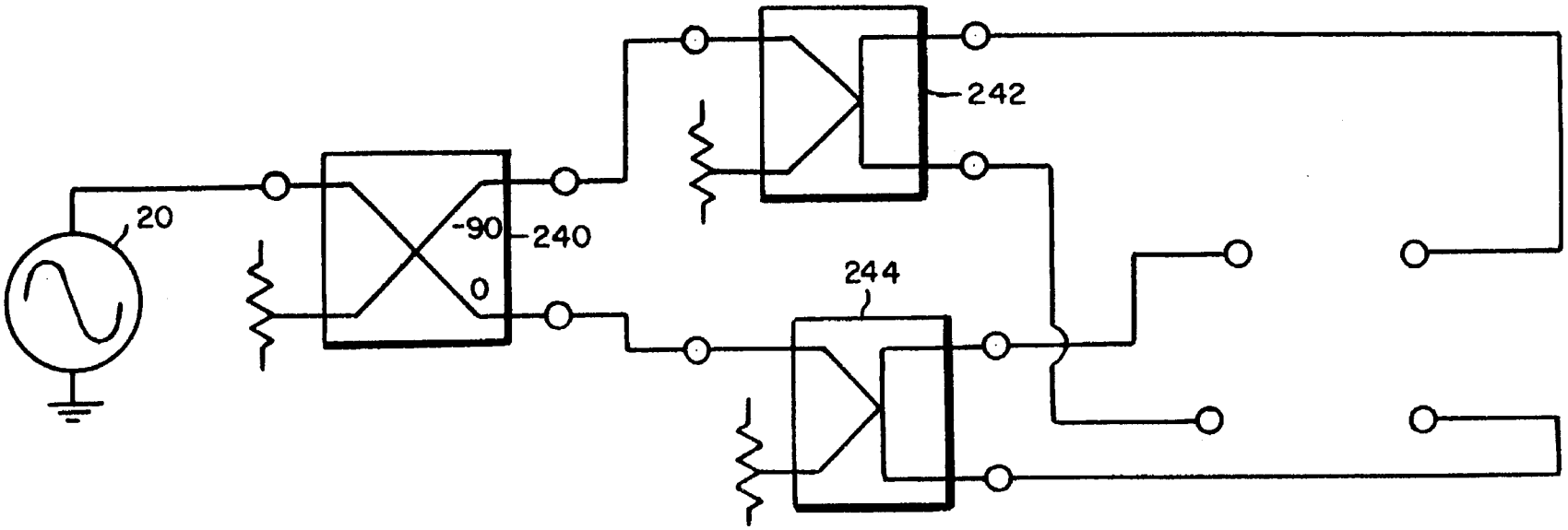
FIG. 9 is a schematic block diagram of a third embodiment of the power splitter and phase shifter shown in FIG. 1.

A third embodiment of the power splitter and phase shifter 22 is shown in FIG. 9. The output of high frequency source 20 is supplied to a quadrature hybrid coupler 240. A first output of coupler 240 is input to a 180° hybrid coupler 242, and a second output of hybrid coupler 240 is input to a 180° hybrid coupler 244. The outputs of each 180° hybrid coupler 242 and 244 are connected to electric field applicators on opposite sides of the lamp capsule so as to produce a rotating electric field as described above.

Figure 10:
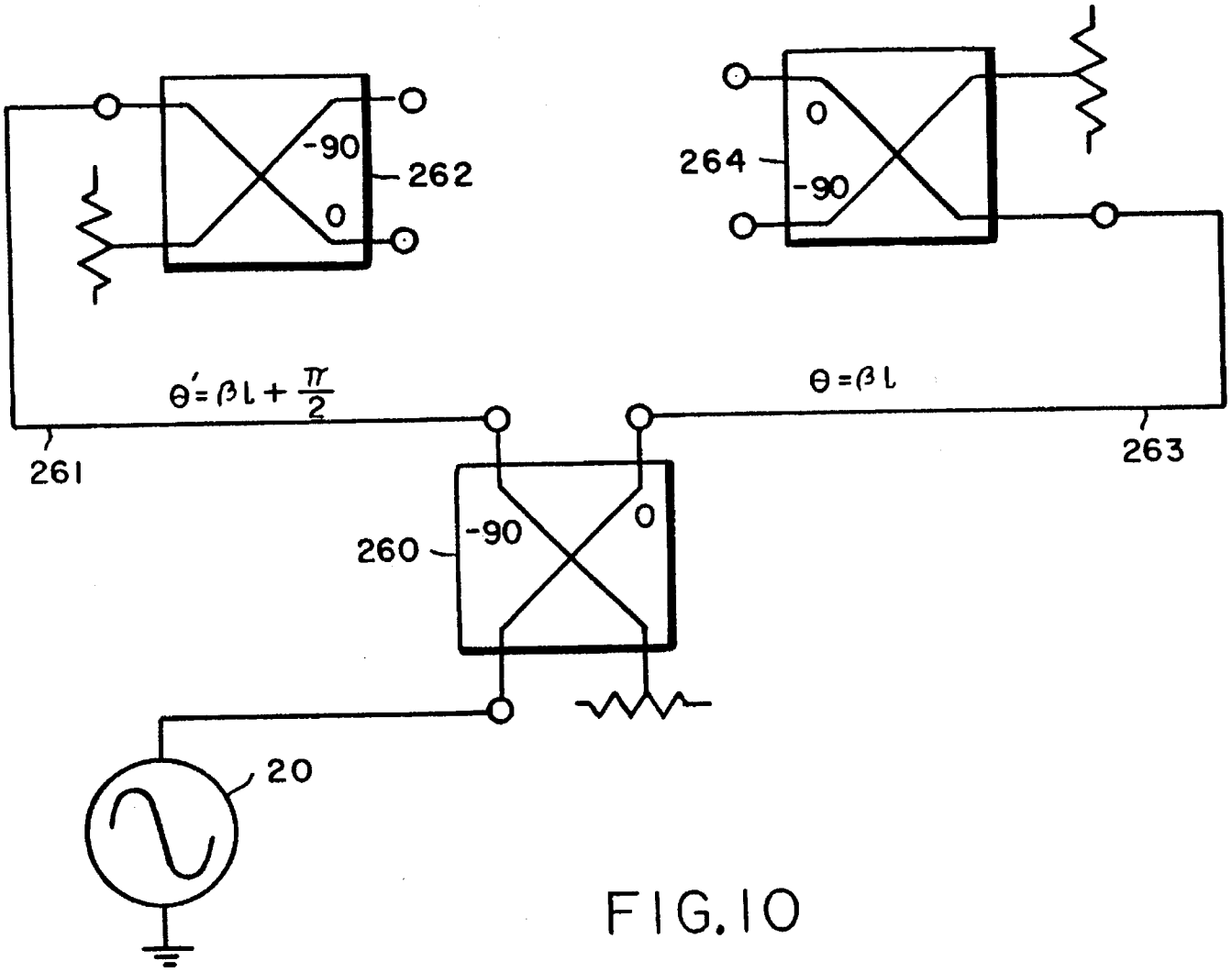
FIG. 10 is a schematic block diagram of a fourth embodiment of the power splitter and phase shifter shown in FIG. 1.

A fourth embodiment of the power splitter and phase shifter 22 is shown in FIG. 10. The electrodeless high intensity discharge lamp shown in FIG. 6 utilizes the configuration of FIG. 10. The output of high frequency source 20 is supplied to a quadrature hybrid coupler 260. A first output of coupler 260 is input to a quadrature hybrid coupler 262 through a transmission line 261 that is approximately one quarter of a guide wavelength longer than a transmission line 263 that connects a second output of coupler 260 to a quadrature hybrid coupler 264. The outputs of quadrature hybrid couplers 262 and 262 are coupled to electric field applicators 12, 14, 16 and 18 so as to produce a rotating electric field as described above.

The power splitter and phase shifter configurations shown in FIGS. 7–10 and described above are preferably fabricated as microstrip transmission lines for simplicity, small size and low cost. To provide a more compact geometry, multilayer microstrip transmission lines can be utilized where appropriate. In each configuration, the unused inputs of the couplers are terminated by resistors so as to insure isolation between the lamp capsule and the source as described above.

Multiple embodiments of the power splitter and phase shifter are shown in FIGS. 7–10 and described above. Additional configurations can be utilized which supply the required amplitude and phase to each of the electric field applicators to produce a rotating electric field within the lamp capsule. Furthermore, any electric field applicator capable of producing the required electric fields within the lamp capsule can be utilized. In general, the combination of the power splitter and phase shifter and the electric field applicators must produce a rotating electric field within the lamp capsule. While the electrodeless HID lamp of the present invention has been described as having four applicators, other numbers of applicators can be utilized, with appropriate changes to the positions of the applicators and the phases of the voltages applied to the applicators. For example, three applicators can be spaced at 120° intervals around the lamp capsule. In this case, the voltages applied to the three applicators are phase shifted by 120° relative to each other.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electrodeless high intensity discharge lamp comprising:

a lamp capsule containing a fill material for emitting light upon excitation by high frequency electromagnetic energy, said fill material comprising a starting gas at a pressure in the range of 1 to 760 torr and a volatilizable material for producing a light-emitting discharge;

four electric field applicators positioned adjacent to said lamp capsule and spaced at 90° intervals with respect to a center of said lamp capsule for nonresonant coupling of said high frequency electromagnetic energy to said lamp capsule;

a high frequency source for supplying said high frequency electromagnetic energy; and a power splitter and phase shifter for coupling said high frequency electromagnetic energy from said source to said applicators, said power splitter and phase shifter including means for supplying said high frequency electromagnetic energy to those of said applicators on opposite sides of said lamp capsule at 180° out of phase and for supplying said high frequency electromagnetic energy to adjacent ones of said applicators at 90° out of phase such that a non-propagating net electric field applied to said lamp capsule by said applicators in response to said high frequency electromagnetic energy rotates at the frequency of said source.

2. An electrodeless high intensity discharge lamp as defined in claim 1 wherein said electric field applicators are positioned in a plane that passes through said lamp capsule.

3. An electrodeless high intensity discharge lamp as defined in claim 1 wherein said volatizible material comprises mercury and a metal halide.

4. An electrodeless high intensity discharge lamp as defined in claim 1 wherein each of said electric field applicators comprises a helical coupler.

5. An electrodeless high intensity discharge lamp as defined in claim 1 wherein each of said electric field applicators comprises a cup applicator having a concave surface.

6. An electrodeless high intensity discharge lamp as defined in claim 1 wherein each of said electric field applicators comprises a loop applicator having three partial turns.

7. An electrodeless high intensity discharge lamp as defined in claim 1 wherein said power splitter and phase shifter comprises first, second and third signal splitters, each having two equal amplitude outputs phase shifted by 90°, said first signal splitter having an input connected to said source, said second signal splitter having an input connected by a first transmission line to one output of said first signal splitter, and said third signal splitter having an input connected by a second transmission line to the other output of said first signal splitter, wherein said first and second transmission lines are configured to modify output signals from the first Splitter so as to provide input signals to the second and third signal splitters of equal amplitude with a phase difference of 180°, the outputs of said second and third signal splitters being respectively coupled to said four electric field applicators.

8. An electrodeless high intensity discharge lamp as defined in claim 7 wherein said first, second and third signal splitters each comprise a branch line quadrature hybrid coupler.

9. An electrodeless high intensity discharge lamp as defined in claim 8 wherein each of said branch line quadrature hybrid couplers comprises microstrip transmission lines.

10. An electrodeless high intensity discharge lamp as defined in claim 1 wherein said power splitter and phase shifter comprises a quadrature hybrid coupler having an input connected to said source and having two equal amplitude outputs phase shifted by 90°, and first and second 180° hybrid couplers having inputs respectively connected to the outputs of said quadrature hybrid coupler, said first and second 180° hybrid couplers each having two outputs, the outputs of said 180° hybrid couplers being respectively connected to said four electric field applicators.

11. An electrodeless high intensity discharge lamp as defined in claim 1 wherein said power splitter and phase shifter comprises a quadrature hybrid coupler having an input connected to said source and two equal amplitude outputs phase shifted by 90°, and two half-wave baluns having inputs respectively connected to the outputs of said quadrature hybrid coupler, said half-wave baluns each having two outputs, the outputs of said half-wave baluns being respectively connected to said four electric field applicators.

12. An electrodeless high intensity discharge lamp as defined in claim 1 wherein said power splitter and phase shifter comprises a 180° hybrid coupler having an input connected to said source and having two equal amplitude outputs phase shifted by 180°, and first and second quadrature hybrid couplers having inputs respectively coupled to the outputs of said 180° hybrid coupler, said first and second quadrature hybrid couplers each having two outputs, the outputs of said quadrature hybrid couplers being respectively connected to said four electric field applicators.

13. An electrodeless high intensity discharge lamp as defined in claim 1 wherein said lamp capsule is substantially spherical and has an inside diameter in a range of 1 to 12 mm.

14. An electrodeless high intensity discharge lamp as defined in claim 1 wherein said lamp capsule has a circular cross-section.

15. An electrodeless high intensity discharge lamp as defined in claim 14 wherein said lamp capsule includes an internal convex dimple for controlling condensate distribution within said lamp capsule.

16. An electrodeless high intensity discharge lamp as defined in claim 1 wherein said lamp capsule comprises an ellipsoid of revolution.

17. An electrodeless high intensity discharge lamp as defined in claim 1 wherein said lamp capsule is a material selected from the group consisting of vitreous silica, synthetic silica, aluminosilicate glass and borosilicate glass.

18. An electrodeless high intensity discharge lamp as defined in claim 1 wherein said lamp capsule includes a lamp envelope that contains said fill material and a support member for supporting said lamp envelope between said applicators.

19. An electrodeless high intensity discharge lamp as defined in claim 1 wherein said starting gas is selected from the group consisting of neon, argon, krypton, xenon, nitrogen and mixtures thereof.

20. An electrodeless high intensity discharge lamp comprising:

a lamp capsule containing a fill material for emitting light upon excitation by high frequency electromagnetic energy, said fill material comprising a starting gas at a pressure in the range of 1 to 760 torr and a volatilizable material for producing a light-emitting discharge;

three electric field applicators positioned adjacent to said lamp capsule and spaced at 120° intervals with respect to a center of said lamp capsule for nonresonant coupling of said high frequency electromagnetic energy to said lamp capsule;

a high frequency source for supplying said high frequency electromagnetic energy; and a power splitter and phase shifter for coupling said high frequency electromagnetic energy from said source to said applicators with phase shifts of 120° between the high frequency electromagnetic energy applied to adjacent applicators such that a non-propagating net electric field applied to said lamp capsule by said applicators in response to said high frequency electromagnetic energy rotates at the frequency of said source.

21. An electrodeless high intensity discharge lamp comprising:

a lamp capsule containing a fill material for emitting light upon excitation by high frequency electromagnetic energy, said fill material comprising a starting gas at a pressure in the range of 1 to 760 torr and a volatilizable material for producing a light emitting discharge;

four electric field applicators positioned adjacent to said lamp capsule and equally spaced at 90° intervals with respect to a center of said lamp capsule for nonresonant coupling of said high frequency electromagnetic energy to said lamp capsule; and a power splitter and phase shifter for receiving said high frequency electromagnetic energy from a source and for coupling said high frequency electromagnetic energy to said applicators, said power splitter and phase shifter including means for supplying said high frequency electromagnetic energy to those of said applicators on opposite sides of said lamp capsule at 180° out of phase and for supplying said high frequency electromagnetic energy to adjacent ones of said applicators at 90° out of phase such that a non-propagating net electric field applied to said lamp capsule by said applicators in response to said high frequency electromagnetic energy rotates at the frequency of said high frequency electromagnetic energy.

* * * * *